United States Patent [19]

Bassoff

[11] 4,408,473

[45] Oct. 11, 1983

[54] GEAR-ROLLER

[75] Inventor: Arthur B. Bassoff, Oak Park, Mich.

[73] Assignee: Lear Siegler, Inc., Mt. Clemens, Mich.

[21] Appl. No.: 319,684

[22] Filed: Nov. 9, 1981

[51] Int. Cl.[3] ..... B21D 53/28; B21H 5/00; B21K 1/30; B23P 15/00

[52] U.S. Cl. ..... 72/108; 72/102; 72/449; 72/454; 29/159.2

[58] Field of Search ..... 72/102, 108, 449, 454; 29/159.2

[56] References Cited

U.S. PATENT DOCUMENTS

| | | | |
|---|---|---|---|
| 2,991,672 | 7/1961 | Meyer et al. | 72/100 |
| 3,712,094 | 1/1973 | Motz et al. | 72/102 |
| 4,307,592 | 12/1981 | Krapfenbauer | 72/95 |

FOREIGN PATENT DOCUMENTS

| | | | |
|---|---|---|---|
| 1946870 | 5/1971 | Fed. Rep. of Germany | 72/108 |

*Primary Examiner*—Lowell A. Larson

*Attorney, Agent, or Firm*—Barnes, Kisselle, Raisch, Choate, Whittemore & Hulbert

[57] ABSTRACT

A gear rolling machine in which a work gear and a conjugate gear-like rolling die are rotated in tight mesh with relative radial pressure of metal deforming intensity applied between the rotating members. The radial feed which applies the pressure is applied by a power train which includes a worm-worm gear combination driving a screw shaft-nut combination. After maximum pressure has been applied, the center distance is reduced by limited predetermined axial movement of the worm, without rotation, in which the worm acts as a rack to provide a predetermined limited rotation of the worm gear, and hence of the screw-nut combination.

17 Claims, 4 Drawing Figures

GEAR-ROLLER

BRIEF SUMMARY OF THE INVENTION

In recent years a method of finishing gears by a metal deforming rolling operation has come into widespread use, as indicated by DiPonio U.S. Pat. No. 3,362,059, assigned to the Ford Motor Company, and Loos U.S. Pat. No. 3,709,015, assigned to Carl Hurth Company, a German manufacturer.

In this operation a hard steel die in the form of a gear is rotated in tight mesh and under metal deforming pressure conditions with a work gear, to which the die is conjugate. The metal deforming pressure is the result of a relative radial approach between the die and tool while they are rotated in mesh with their axes at least substantially parallel. Forces as great as 60,000 pounds may be applied to a movable die or work support.

It has been found that desirable results in surface finish, particularly in the elimination of very small metal particles displaced or partly separated from the surfaces of the gear teeth, are obtained when the rolling cycle comprises relative radial depth feed to provide a small reduction in size of the work gear, followed by a brief dwell in which the gear and die are maintained at a constant center distance, followed by a small incremental increase in center distance between the gear and die while rotation is continued. This increase in center distance will vary for different size gears, but in general may be on the order of 0.001". The increase in center distance is abrupt, and the gear and die are rotated for at least several revolutions while the increased center distance is maintained constant.

The present invention is directed to a novel feed apparatus for applying the requisite forces to a movable gear or tool slide to produce a cold flow of metal in the teeth of the gear, and in providing a very accurately controlled brief increase in the center distance between the gear and die during continued rotation as the final phase of the rolling operation.

DETAILED DESCRIPTION

Figure 2:
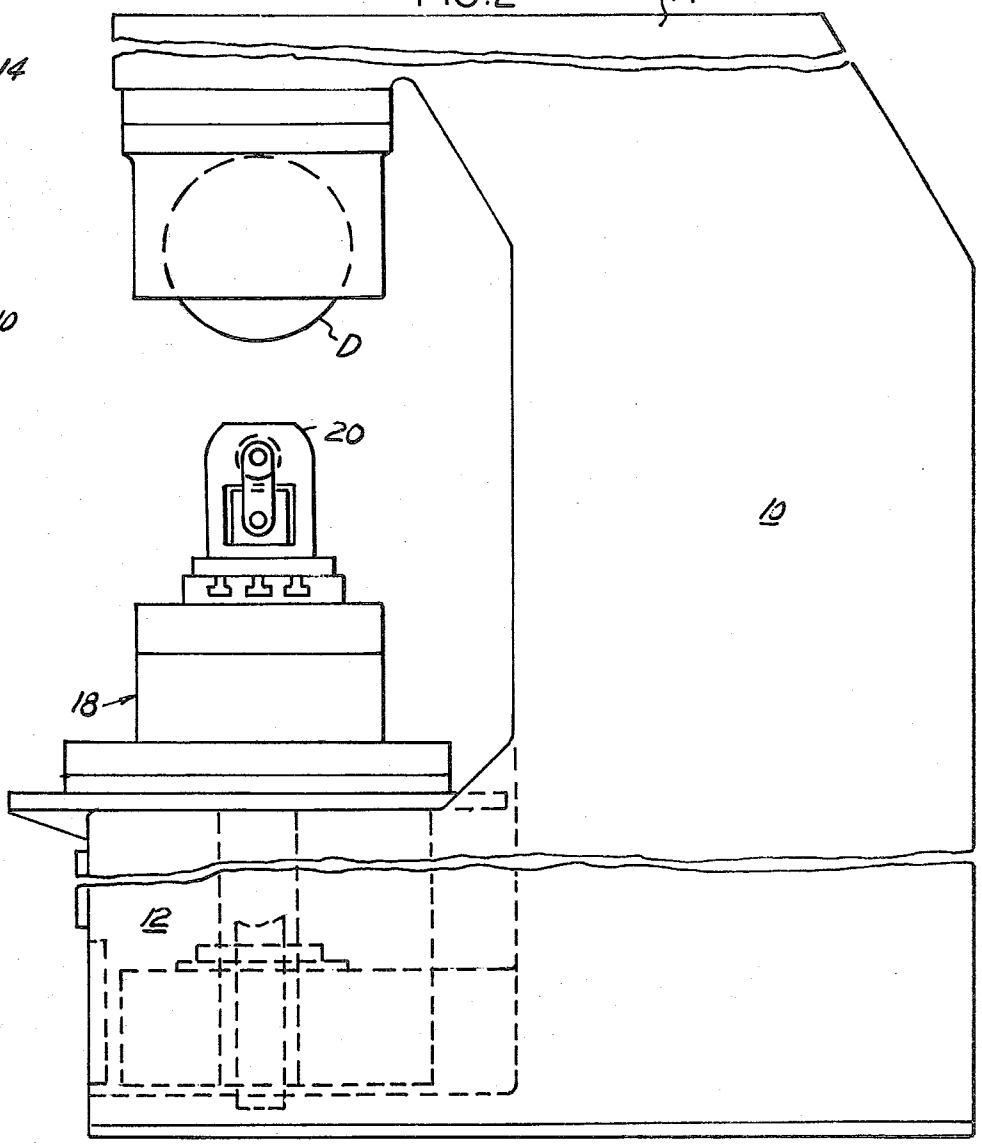
FIG. 2 is a side elevation of the machine.
Figure 1:
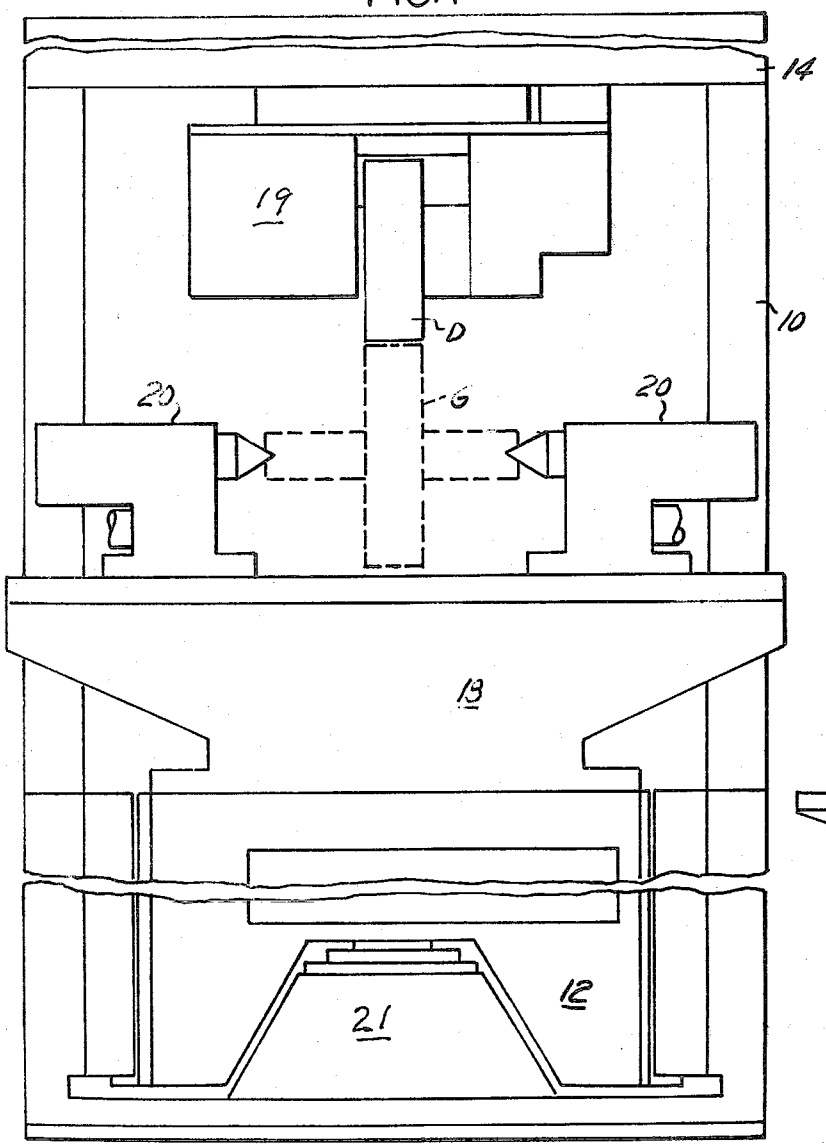
FIG. 1 is a front elevation of the gear rolling machine.
Figure 3:
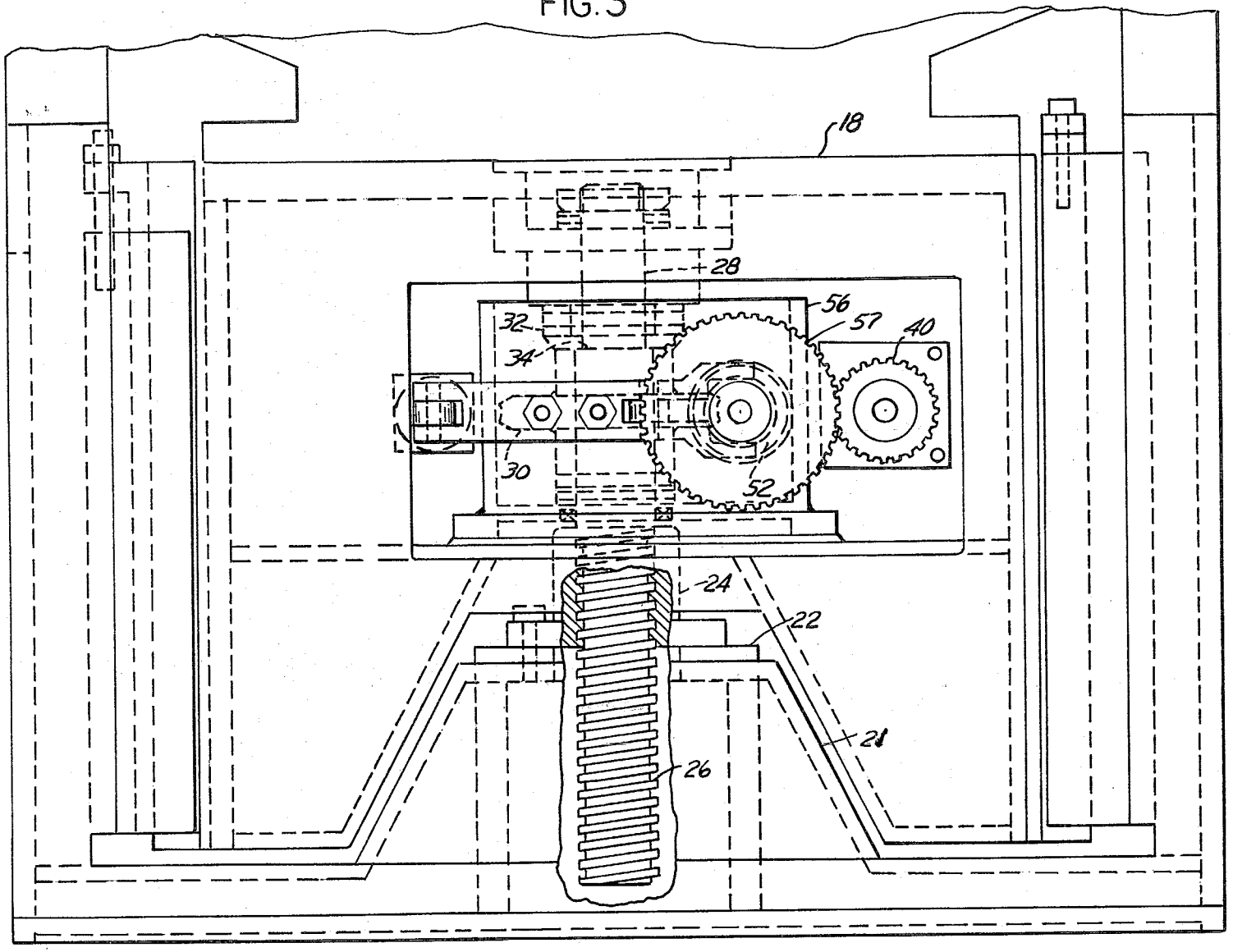
FIG. 3 is an enlarged partly sectioned elevation of the infeed mechanism.

The gear rolling machine is seen in FIGS. 1 and 2. It comprises a frame of C-shape having a vertical column 10, a forwardly projecting base portion 12 at the bottom of the column, and a forwardly projecting head portion 14 at the top of the column overlying the base portion 12.

Vertically movable on guideways indicated at 16 is a knee or slide 18 which carries rugged stocks 20 for supporting a work gear G for rotation in mesh with a conjugate hardened steel die D.

Motor means are provided in the head portion 14 and are connected in driving relation to the die D through gearing contained partly in head 14 and partly in a transmission housing 19 which supports the die.

The portion of the base 12 which is beneath head portion 14 comprises a conical pedestal 21 having a flat support plate 22 welded thereto. A feed nut 24 is bolted to plate 22, which cooperates with a lift screw 26 rotatably supported in vertically movable knee 18. Fixed to the upper end of the shaft 28 which at its lower end is formed to provide the lift screw is a worm gear 30. Rotation of the worm gear 30 relative to the stationary nut 24 of course results in vertical movement of the shaft 28. A heavy duty thrust bearing 32 transmits lifting force from shoulder 34 on the shaft to the knee 18.

Vertical movement of the knee 18 is derived from a hydraulic motor 36 having an output shaft 38 to which is fixed a drive pinion 40. The hydraulic motor has the characteristic that when the flow of hydraulic fluid is terminated, rotation of the output shaft is positively blocked.

Accordingly, the motor 36 constitutes blocking means for blocking rotation of said motor when the supply of fluid under pressure to motor 36 is terminated.

Figure 4:
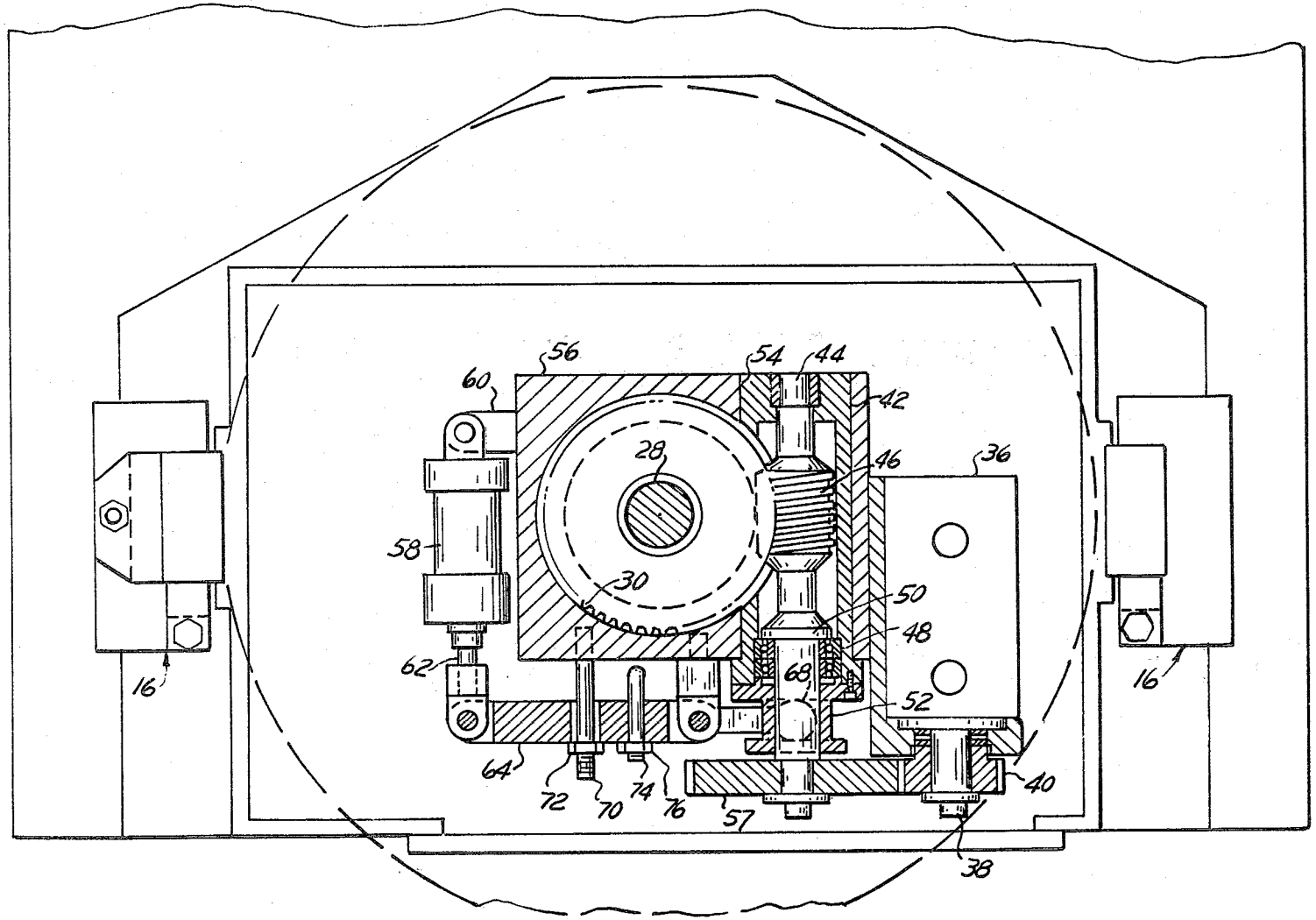
FIG. 4 is a plan view of the mechanism shown in FIG. 3.

Mounted for rotation in a longitudinally slidable sleeve 42 is a shaft 44 having an enlarged intermediate portion constituting a worm 46 which is in mesh with the worm gear 30. Shaft 44 has a bearing 48 retained between a shoulder 50 on the shaft and an externally grooved collar 52 fastened to an end of sleeve 42 as shown in FIG. 4. Sleeve 42 is slidable longitudinally in a bore guideway 54 provided in housing 56.

Gear 57 is fixed to shaft 44 and is in mesh with pinion 40.

A cylinder 58 is pivoted to an ear 60 on housing 56, and an operating piston rod 62 is pivotally connected to one end of lever 64, which in turn is pivoted to a lug fixed to housing 56. The other end of lever 64 has rounded ears 68 which are received without clearance in the annular groove of collar 52. Lever 64 is apertured to receive a threaded stud 70 carrying an adjustable stop nut 72 limiting pivotal movement of lever 64 in one direction. A threaded adjustable abutment pin 74 provided with a jamb nut 76 is engageable with housing 56 to limit pivotal movement of lever 64 in the other direction.

When the supply of hydraulic fluid to motor 36 is terminated, its rotor is blocked and pinion 40 and gear 57 prevent rotation of worm 46. However worm 46 and its support sleeve 42 are axially slidable by a small adjustable increment as determined by stop nut 72 and abutment pin 74 when operated by cylinder 58.

The relative great force required to raise the knee 18 and to apply metal deforming pressure to the gear teeth is provided by the transmission in which mechanical advantage is derived from the pinion-gear combination 40, 57; the worm-worm gear combination 46, 30; and the screw-nut combination 26, 24. A machine capable of generating a lifting force of 66,000 pounds is easily obtained with a 5 H.P. hydraulic motor designed to operate with hydraulic fluid supplied at 750 P.S.I. Hydraulic fluid under pressure is supplied to motor 36 and causes gradual movement of said knee to take place with corresponding deformation of the teeth of the work gear during several rotations of the work gear. When the supply of actuating fluid to motor 36 is terminated, motor 36 is blocked and no further approach between the work gear and die takes place during several additional rotations of the work gear. Thereafter, while the work gear and die continue to rotate, fluid is admitted to cylinder 58 and an abrupt accurately predetermined axial shifting of worm 46 occurs to provide slight downward movement of knee 18 to relax the pressure between the work gear and die.

In operation, the work gear G is mounted on the knee 18 in mesh with die D, which is positively driven in rotation, and which rotates freely rotatable gear G. Motor 36 is energized by providing a flow of high pressure hydraulic fluid through the motor and screw shaft 26 is rotated, moving gear G into tight mesh with die D. Since the gear is freely rotatable, the metal deforming pressure between the teeth of the die and gear is applied substantially equally in total to both sides of the gear teeth.

Since the hydraulic motor is inherently non-positive in operation, its output shaft, once tight mesh is achieved, is permitted only as deformation of the metal in the gear teeth is achieved. The work gear, which is ordinarily steel, at first undergoes elastic deformation, and when its elastic limit is reached, undergoes plastic deformation. It will be noted that the instantaneous contact between die teeth and work gear teeth, disregarding deformation, is line contact. Due to deformation, it is in the form of a narrow band extending from end to end of the teeth. Moreover this line or band of contact on the gear teeth travels from root to crest, or vice versa, as the parts rotate. In addition, rolling contact takes place only at the pitch diameter, and the heavy pressure contact above and below the pitch diameter is a variable sliding contact, increasing in magnitude with increased distance from the pitch diameter.

Accordingly, the action on the gear teeth may be visualized as an ironing action progressing across the teeth between root and crest. As a result of this action, while the metal is generally displaced in an elastic and ultimately plastic flow, it is found that some metal particles may be separated or partly separated from the tooth surface.

In accordance with the present invention, supply of hydraulic fluid under pressure to the hydraulic motor is terminated, and the hydraulic fluid trapped in the motor provides a positive blocking of the output shaft against rotation, thus terminating infeed.

At this time, while rotation of the gear and die is continued, hydraulic fluid is supplied to cylinder 58 in the appropriate direction, and as a result worm 46 is shifted axially to act as a rack in mesh with worm gear 30 to provide a very small but positively controlled rotation of screw shaft 26, to lower the knee 18 by a definite increment. The precise amount of separation thus provided between the gear and die required in particular instances will be variable, but a movement on the order of about 0.001" is typical.

It will be understood that this action terminates plastic deformation of metal in the gear teeth, but the teeth of the gear and die remain in tight mesh at a pressure which continues to cause elastic deformation. At this time it is believed that any particles separated or partly separated from the surfaces of the gear teeth are ironed or pressure welded back into the finished gear teeth surfaces. In any event, the rolled teeth obtained by this apparatus have a superior finish, and the presence of partially separated or loose particles is avoided.

While lifting forces of 60,000 and 66,000 pounds have been mentioned, it may be said in general terms that the lifting force, or total pressure acting between the teeth of the gear and die, are in excess of 50,000 pounds.

I claim:

1. A gear rolling machine for finish rolling gears comprising a rigid frame, a rotary work support on said frame for supporting a work gear thereon, a rotary tool support on said frame for supporting a gear-like die thereon in position to mesh with a work gear on said work support, means for driving one of said rotary supports in rotation, and feed means for mounting one of said supports on said frame for movement in a direction such that a work gear and a gear-like die in mesh with each other develop pressure of metal deforming intensity between the teeth thereof, said feed means comprising feed screw and nut members connected between the movable support and said frame, and means for effecting relative rotation between the feed screw and nut members comprising a worm gear fixed to one of said members, a worm in meshed engagement with said worm gear, means mounting said worm for rotation and for limited axial displacement, drive means connected to said worm for rotating said worm, blocking means to terminate rotation of said worm and to maintain said worm positively against further rotation, and pressure relaxing means to displace said worm axially without rotation thereof to effect predetermined rotation of said worm gear to in turn effect a relative rotation between said nut and screw members and controlled separation between said work gear and die to substantially reduce the pressure between the meshed teeth thereof.

2. A machine as defined in claim 1, in which the movable support is movable in a direction to cause said gear and die to have relative radial movement therebetween.

3. A machine as defined in claim 1, in which the drive means connected to said worm comprises a hydraulic motor having an output shaft whose rotation is positively blocked when flow of hydraulic fluid through said motor is terminated, a pinion fixed to said shaft, and a gear in mesh with said pinion connected in driving relation to said worm.

4. A machine as defined in claim 3, which comprises a housing having a guideway, a sleeve slidable axially in said guideway in which said worm is rotatable, said worm gear being mounted in said housing in mesh with said worm, a grooved collar being fixed to said sleeve, a lever pivoted to one side of said housing having portions at one end received in said collar, adjustable abutment means operably connected to said lever and cooperable with said housing to limit pivotal movement of said lever to in turn effect limited axial movement of said worm, the means for pivoting said lever comprising a fluid piston and cylinder device pivotally mounted on a side of said housing adjacent to the side on which said lever is mounted and connected to the other end of said lever.

5. A machine as defined in claim 1, in which said pressure relaxing means comprises a lever having an end portion operatively connected to said worm to effect axial displacement thereof, adjustable abutment means limiting pivotal movement of said lever, and means for pivoting said lever to effect axial displacement of said worm.

6. In a gear rolling machine comprising a base, a column, a head at the top of said column overlying said base, a knee slidable vertically on said column, a rotary support on said head, a second rotary support on said knee, said supports being effective to position a gear and gear-like die in tight mesh, drive means in said head connected to the rotary support on said head, the improvement which comprises depth feed mechanism including a feed nut fixed in said base, a vertical feed screw in said nut mounted in said knee for rotation only and having a thrust connection to move said knee vertically upon rotation of said screw, a blocking rotary hydraulic motor in said knee, a pinion driven by said motor and locked against rotation when said motor is blocked, a worm gear fixed to said feed screw, a worm in said knee in mesh with said worm gear, means mounting said worm for limited axial displacement, a gear in driving relation to said worm and in mesh with said pinion, and means for effecting predetermined limited axial displacement of said worm while rotation of said motor is blocked.

7. Mechanism as defined in claim 6, in which the mechanical advantage attributable to the series connected pinion-gear combination, the worm-worm gear combination and the screw-nut combination generates a force acting radially between the tightly meshed gear and die in excess of 50,000 pounds.

8. Mechanism as defined in claim 7, in which said lever has an adjustable range of movement effective to produce controlled vertical movement of the rotary support on said knee of a few one thousandths of an inch.

9. Mechanism as defined in claim 6, in which said lever has an adjustable range of movement effective to produce controlled vertical movement of the rotary support on said knee of a few one thousandths of an inch.

10. Mechanism as defined in claim 6, in which the means for effecting limited axial displacement of said worm comprises a fluid actuated piston and cylinder device connected to said worm and operable to produce abrupt displacement of said worm.

11. Mechanism as defined in claim 10, in which said motor is operated at a speed relative to the speed of rotation of the work gear to cause gradual movement of said knee throughout several rotations of the work gear and in which during continued rotation of said work gear and die in tight mesh said piston and cylinder device is actuated to effect abrupt downward movement of said knee of not more than a few thousandths or ten thousandths of an inch while still preserving the condition of tight mesh between the work gear and die for a further several rotations of the work gear, followed by final separation between the work gear and die.

12. Mechanism as defined in claim 11, in which in the final rotation of the gear and die in tight mesh, the contact pressure between the teeth thereof is such as to produce only elastic deformation of the metal at the surface of the gear teeth.

13. A gear rolling machine comprising a base, a column, a head at the top of said column overlying said base, a knee slidable vertically on said column, a rotary support on said head, a second rotary support on said knee, said supports being effective to position a gear and gear-like die in tight mesh, drive means in said head connected to the rotary support on said head, depth feed mechanism connected between said base and said knee comprising a nut fixed in said base, a vertical rotatable screw in said nut having a thrust connection with said knee, a unitary assembly in said knee movable vertically therewith comprising a housing, a worm gear in said housing operatively connected to said screw to rotate said screw, a sleeve longitudinally movable in said housing, an elongated shaft rotatable in said housing and longitudinally movable therewith, a worm fixed to said shaft within said housing and in mesh with said worm gear, said shaft having an end portion located exterior to said housing, a gear fixed to the end portion of said shaft, a hydraulic motor fixed to the exterior of said housing having an output shaft carrying a drive pinion in mesh with said gear, said motor being of the type in which the hydraulic fluid blocks rotation of its output shaft when flow of hydraulic fluid through said motor is interrupted, a lever pivoted to said housing having an actuating connection with said shaft effective to shift said shaft axially when said lever is pivoted, adjustable abutments acting between said housing and said lever effective to limit pivotal movement of said lever, and lever actuating means carried by said housing and connected to said lever to effect pivotal movement thereof to move shaft and said worm axially and thereby to rotate said worm gear and screw relative to said nut to effect controlled very slight withdrawal of said knee from said head.

14. A machine as defined in claim 13 in which said lever actuating means comprises a fluid actuated device effective to cause relatively abrupt pivotal movement of said lever.

15. In a gear rolling machine comprising a frame, a first rotary support on said frame, a slide movable on said frame toward and away from said first support, a second rotary support on said slide, means for driving one of said supports in rotation, pressure feed mechanism for applying forces of metal deforming intensity between a hardened gear-like die, mounted one of said first and second rotary supports, and a work gear, mounted on the other of said first and second rotary support rotating in tight mesh therewith to cause approach between the work gear and die as permitted by deformation of the gear teeth, to terminate approach between the work gear and die while rotation continues, and to cause a very slight separation movement between the work gear and die while the work gear and die continue to rotate in tight mesh, comprising a rotary hydraulic motor on said frame of the type in which the hydraulic fluid positively blocks rotation of the motor when the flow of hydraulic fluid is terminated, a power transmission train connecting said motor to said slide comprising a pinion-gear combination in which the pinion is directly driven by said motor, a worm-worm gear combination in which said worm is directly driven by said gear, and a screw-nut combination in which one of the elements thereof is directly driven by said worm gear, and means for shifting said worm axially while its rotation is blocked by termination of flow of hydraulic fluid through said motor.

16. Mechanism as defined in claim 15, in which the means for shifting the worm axially comprises a lever operatively connected thereto, adjustable abutment means limiting pivotal movement of said lever, and lever actuating means for effecting relatively abrupt pivotal movement of said lever.

17. Mechanism as defined in claim 16, in which said lever actuating means comprises a fluid actuated device.

* * * * *